US007583165B2

(12) United States Patent
Green

(10) Patent No.: US 7,583,165 B2
(45) Date of Patent: Sep. 1, 2009

(54) HIGH Q CAVITY RESONATORS FOR MICROELECTRONICS

(75) Inventor: Ronald Green, San Jose, CA (US)

(73) Assignee: Tessera, Inc., San Jose, CA (US)

( * ) Notice: Subject to any disclaimer, the term of this patent is extended or adjusted under 35 U.S.C. 154(b) by 365 days.

(21) Appl. No.: 11/319,849

(22) Filed: Dec. 28, 2005

(65) Prior Publication Data

US 2006/0176130 A1 Aug. 10, 2006

Related U.S. Application Data

(60) Provisional application No. 60/650,505, filed on Feb. 7, 2005.

(51) Int. Cl.
*H01P 1/203* (2006.01)
*H01P 1/20* (2006.01)

(52) U.S. Cl. ..... 333/202; 333/204; 333/230

(58) Field of Classification Search ..... 333/204, 333/230, 202, 205, 212
See application file for complete search history.

(56) References Cited

U.S. PATENT DOCUMENTS 6,570,472 B1 * 5/2003 Niiranen ..... 333/204
6,741,142 B1 * 5/2004 Okazaki et al. ..... 333/99 S
2003/0062541 A1 4/2003 Warner
2004/0032011 A1 2/2004 Warner et al.

* cited by examiner

*Primary Examiner*—Stephen E Jones
(74) *Attorney, Agent, or Firm*—Lerner, David, Littenberg, Krumholz & Mentlik, LLP

(57) ABSTRACT

A cavity resonator is provided which includes a shielded enclosure enclosing a volume and a unitary conductor disposed within the volume, the unitary conductor having a first inductor portion and a transmission line portion. The transmission line portion is included in a transmission line having a reference conductor separated from the transmission line portion by a dielectric element. An active semiconductor device is coupled to the unitary conductor, and is operable to conduct a current to the unitary conductor at a resonant frequency of the unitary conductor.

30 Claims, 5 Drawing Sheets

HIGH Q CAVITY RESONATORS FOR MICROELECTRONICS

CROSS-REFERENCE TO RELATED APPLICATION

This application claims the benefit of the filing date of U.S. Provisional Application No. 60/650,505 filed Feb. 7, 2005, the disclosure of which is hereby incorporated herein by reference.

BACKGROUND OF THE INVENTION

The present invention relates to filters, particularly filters which include cavity resonators, for use in microelectronic devices and assemblies, e.g., chips, substrates and circuit panels.

Filters play a critical role in the operation of radio receivers and transmitters. In receivers, high-Q filters are used to confine received signal energy to narrow passbands in order to reject noise and spurious harmonics that interfere with the reception of the intended signal. In transmitters, high-Q filters are used to restrict the bandwidth of signals to be amplified to designated channels, for example, for the purpose of increasing the signal to noise ratio of the transmitted signal and to avoid the transmitted signals from interfering with out-of-band signals.

Many filters used in microelectronics employ lumped components, e.g., capacitors and inductors, which are combined to form resonant circuits, for example, to select a narrow fixed passband of an intermediate frequency ("IF") or baseband ("BB") signal in a receiver. Lumped components may be provided as discrete components mounted to a circuit panel or other interconnection element. Alternatively, distributed components or both lumped and distributed components may be provided as elements of a chip or microelectronic substrate commonly known as "integrated passives on chip" (IPOC). The Q value of each component in a filter strongly influences the overall performance of the filter. In order for filters to provide good rejection of out-of-band energy and noise, they need to operate with a high "Q" value. High Q values generally result in the following benefits: a greater degree of signal isolation, the ability to achieve narrower passbands, and sharper filter roll-off.

Unfortunately, the Q value of traditional lumped components is inadequate for these purposes. Traditional lumped capacitors used in microelectronic devices, such as in capacitors of an IPOC, typically have unloaded Q values which are below 200. Lumped inductors used in microelectronics, e.g., inductors which are formed as traces on a microelectronic dielectric sheet, typically have unloaded Q values which are below 100. Such unloaded component Q values lead to circuit Q values of about 10 in resonant circuits which include the components. Circuit Q values of about 10 are inadequate to achieve the above-indicated goals.

Outside the field of microelectronics, one class of resonant circuits, the helical cavity resonator, has a characteristically high unloaded Q value. Such resonators typically have Q values ranging between about 500 and 1000 over frequencies selected between about 10 MHz and 1000 MHz. As used herein, a "cavity resonator" is defined as a chamber, which may be hollow, or, alternatively packed with a dielectric material, whose dimensions allow the resonant oscillation of electromagnetic waves, and in which is disposed an inductive element for exciting the electromagnetic waves.

An example of a two-stage helical cavity resonator 50 is illustrated schematically in a sectional view thereof in FIG. 1.

As shown therein, the helical cavity resonator 50 includes a shielded enclosure 60, which encloses a first volume 62 and a second volume 64 and having an internal shield 66 which separates the first volume 62 from the second volume 64. The shielded enclosure 60 is cubic or cuboid in shape, having planar walls 61, each of which presents a conductive surface to the first and/or second volumes 62, 64 enclosed by the shielded enclosure. The shielded enclosure 60 is typically held at a fixed potential, e.g., ground, thus forcing the conductive interior surfaces of the walls 61 of the enclosure to be held at that potential, e.g., ground.

A first helical coiled inductor 70 is disposed within the first volume 62 and a second helical coiled inductor 72 is disposed within the second volume 64. The first inductor 70 has a ground end 71 mounted to the shielded enclosure 60, shown here as being mounted to the internal shield 66. Likewise, the second inductor 72 also has a ground end 73 mounted to the shielded enclosure 60, also shown as being mounted to the internal shield 66. In addition, the first inductor has an open end 74 and the second inductor has an open end 76. Connected to the first inductor 70 is a first transmission line 80 having a characteristic impedance such as 50Ω. A second transmission line 82 is connected to the second inductor 72, also having a characteristic impedance which is typically the same as that of the first transmission line 80, e.g., an impedance of 50Ω. Each of the first and second transmission lines extends from inside the shielded enclosure 60 through openings 86, 88, respectively, to the space 85 outside the shielded enclosure. Transmission line 80 includes an active conductor 87 and a grounded conductor 81. Transmission line 82 includes an active conductor 89 and a grounded conductor 83. The grounded conductors 81, 83 typically are in conductive communication with the shielded enclosure 60, and/or one or more external ground points (not shown) in order to provide a stable ground for the transmission lines.

One requirement in fabricating the helical cavity resonator is to attach the active conductors 87, 89 of the transmission lines to the inductive elements 70, 72, respectively, at a location which terminates the transmission lines in matched impedances. Unfortunately, achieving such terminations is difficult. Because the cavity resonator is very sensitive to variations in dimensions and the shape of the inductive element, painstaking manual adjustments must be made in order to achieve the matched impedance. Moreover, the same hand-tuning must be performed for each such cavity resonator being manufactured, because the dimensions and shape of the inductor (and hence, its impedance) are subject to variations.

The helical cavity resonator 50 operates to resonate at a predetermined resonant frequency $f_0$ which is determined by the inductance of the inductors 70, 72 and the dimensions and geometry of the shielded enclosure 60. Due to the boundary conditions imposed by the walls 61 of the shielded enclosure, an electromagnetic field of standing waves is excited in the first volume at the resonant frequency $f_0$. Such electromagnetic field is excited by an excitation current delivered onto the first inductor 70 by the first transmission line 80. An opening 68 is provided in the internal shield 66 for the purpose of coupling energy from the electromagnetic field excited by the first inductor 70 onto the second inductor 72. The first and second inductors 70, 72 and the shielded enclosure 60 cooperate together in exciting a current in the second inductor 72 having an amplitude which is very sensitive to the frequency of the excitation current present on the first inductor 70. The excited current on inductor 72 is output onto the second transmission line 82. The excited current output onto transmission line 82 is the same as or exceeds the excitation current provided onto inductor 70 when the frequency of the excitation current is at the resonant frequency of the cavity resonator 50. However, very little excited current is produced in the second inductor 72 unless the frequency of the excitation current is at or near the resonant frequency. In this manner, the helical cavity resonator 50 operates as a filter to select a narrow passband between a signal arriving on first transmission line 80 and output onto second transmission line 82.

The merits of the helical cavity resonator are best illustrated with reference to FIG. 2. As shown therein, FIG. 2 is a chart comparing the frequency response of a first type of bandpass filter which employs a helical cavity resonator (curve 10), as compared to a second type of bandpass filter (curve 12) which employs lumped circuit elements. In addition, the first filter type has a much narrower passband. Each of the first and second filter types has a nominal center frequency $f_0$. By convention, the passband is generally considered to be the range of frequencies which lie between a lower "3 dB frequency" and an upper "3 dB frequency". The lower 3 dB frequency is the frequency below $f_0$ at which the frequency response is 3 dB lower than the peak frequency response (the frequency response at $f_0$). The upper "3 dB frequency" is a frequency above $f_0$ at which the frequency response is 3 dB lower than the peak frequency response. As illustrated in FIG. 2, the passband 20 of the first filter type lies between the lower 3 dB frequency 30 and the upper 3 dB frequency 32. On the other hand, the passband 22 of the second filter type lies between the lower 3 dB frequency 40 and the upper 3 dB frequency 42. As apparent from FIG. 2, the passband 20 of the first filter type, having a helical cavity resonator, is much narrower than the passband 22 of the second filter type having lumped circuit elements.

Unfortunately, the available helical cavity resonators available heretofore are heavy, expensive and bulky, typically being constructed of helical coils of copper tubing which is disposed within in metal chambers. Aside from that, fabrication of such resonators is difficult. In particular, the task of properly terminating the helical inductor element in such resonators is expensive and arduous, because the 50 ohm termination point is difficult to determine prior to constructing the helical coil and the metal chamber. Because of the size and weight of helical cavity resonators and the difficulties involved in providing the appropriate termination point, heretofore the use of such resonators has been limited to applications outside the field of microelectronic devices and microelectronic assemblies.

However, as explained above, there is a present need for resonant circuits in microelectronics having higher Q values. Accordingly, it would be desirable to provide a new high Q value resonator component suitable for use in or with microelectronic assemblies.

SUMMARY OF THE INVENTION

Therefore, according to an aspect of the invention, a cavity resonator is provided which includes a sheet-like dielectric element having one or more dielectric layers, and a shielded enclosure overlying at least a portion of the dielectric element, the shielded enclosure enclosing a first volume and a second volume and having a metallic divider separating the first volume from the second volume.

A first unitary trace is disposed within the first volume, the first unitary trace including a first transmission line trace extending along the dielectric element and a first inductor trace. A first reference trace extends along the dielectric element and is separated from the first transmission line trace by at least one dielectric layer of the dielectric element.

A second unitary trace is disposed within the second volume, the second unitary trace including a second transmission line trace extending along the dielectric element and a second inductor trace. A second reference trace extends along the dielectric element and is separated from the second transmission line trace by at least one dielectric layer of the dielectric element.

In addition, the metallic divider between the first and second volumes has an opening adapted to permit a predetermined proportion of energy of an electromagnetic field excited by the first inductor trace to be coupled onto the second inductor trace.

According to a particular aspect of the invention, the shielded enclosure includes a top enclosure which encloses portions of the first volume and the second volume above the dielectric element. In addition, a bottom enclosure encloses portions of the first volume and the second volume below the dielectric element. The metallic divider includes a top divider separating the first volume from the second volume within the top enclosure and a bottom divider separating the first volume from the second volume within the bottom enclosure.

In accordance with one or more further aspects of the invention, the dielectric element includes a plurality of third traces disposed outside the shielded enclosure for which at least some of the third traces are not connected to either the first unitary trace or the second unitary trace. In accordance with such aspect, the dielectric element may include a ground plane separated from the third traces by at least one dielectric layer of the dielectric element, the ground plane being connected to the first and second reference conductors.

In accordance with a particular aspect of the invention, each of the first inductor trace and the second inductor trace has a spiral form, or each of the first and second inductor traces has helical form, or even each of the first and second inductor traces has tapered helical form.

In accordance with one or more further aspects of the invention, the dielectric element includes a substantially planar surface that is disposed outside the shielded enclosure, as well as first and second frusto-conical inductor surfaces disposed inside the shielded enclosure. The first and second inductor surfaces have tops which are displaced vertically from the planar surface and the first and second inductor traces are each disposed in a spiral pattern along the first and second inductor surfaces, respectively. In accordance with such aspect of the invention, the first and second transmission line traces and the first and second reference traces are disposed on opposite sides of the substantially planar surface. The cavity resonator may further include a ground plane, in which the first and second reference traces are portions of the ground plane.

According to another aspect of the invention, a cavity resonator is provided which includes a shielded enclosure enclosing a first volume and a second volume, the shielded enclosure having a shield separating the first volume from the second volume.

A first unitary conductor and a first reference conductor are provided which extend within the first volume, the first unitary conductor having a first inductor portion disposed within the first volume and a first transmission line portion. A first dielectric element separates the first transmission line portion from the first reference conductor so that the first transmission line portion of the first unitary conductor, the first dielectric element and the first reference conductor define a first transmission line.

A second unitary conductor and a second reference conductor are provided which extend within the second volume, the second unitary conductor having a second inductor portion disposed within the second volume and a second transmission line portion. A second dielectric element separates the second transmission line portion from the second reference conductor so that the second transmission line portion of the second unitary conductor, the second dielectric element and the second reference conductor define a second transmission line.

The shield between the first and second enclosed volumes is further provided with an opening allowing a predetermined proportion of energy radiated by the first inductor portion to be radiatively coupled to the second inductor portion.

In a cavity resonator according to one or more further aspects of the invention, the first transmission line and the second transmission line extend through one or more openings in the shielded enclosure to locations outside the shielded enclosure. According to one or more further aspects of the invention, one or more encapsulating members insulate the first transmission line and the second transmission line at the one or more openings.

In a cavity resonator according to one or more further aspects of the invention, the first dielectric element and the second dielectric element are portions of a unitary dielectric element.

In a cavity resonator according to one or more further aspects of the invention, the first reference conductor and the second reference conductor are adapted to be connected to the same reference potential.

In a cavity resonator according to one or more further aspects of the invention, the first inductor portion and the second inductor portion include ground ends conductively bonded to the shielded enclosure.

In a cavity resonator according to one or more further aspects of the invention, the shielded enclosure includes an inner surface having a silver coating disposed thereon. In such aspect, the first inductor portion and the second inductor portion may further include silver coatings.

In a cavity resonator according to one or more further aspects of the invention, each of the first inductor portion and the second inductor portion has spiral form, or each of the first inductor portion and the second inductor portion has helical form, or each has a tapered helical form.

A cavity resonator according to one or more further aspects of the invention may further include a first dielectric mounting element and a second dielectric mounting element. In such aspect, the first inductor portion has a first open end and a first ground end opposite the first open end. The second inductor portion has a second open end and a second ground end opposite the second open end. The first open end is mounted to the first dielectric mounting element and insulated from the shielded enclosure thereby. The second open end is mounted to the second dielectric mounting element and insulated from the shielded enclosure thereby.

In a further preferred aspect of the invention, the first dielectric mounting element and the second dielectric mounting element are mounted to the shielded enclosure.

According to a preferred aspect of the invention, a dielectric loading material occupies at least a substantial portion of the first volume and the second volume. In a particular preferred aspect of the invention, the dielectric loading material includes a multiplicity of solid dielectric nodules.

In a cavity resonator according to one or more further aspects of the invention, the first reference conductor and the second reference conductor are portions of a unitary ground conductor that includes a ground plane portion disposed at an interior surface of the shielded enclosure.

In a cavity resonator in accordance with one or more further aspects of the invention, each of the first enclosed volume and the second enclosed volume has substantially cuboid shape.

According to a particular aspect of the invention, a assembly includes a cavity resonator according to one or more of the herein-described aspects of the invention. Such assembly further includes a circuit panel having a plurality of signal traces. The first transmission line portion and the second transmission line portion of the cavity resonator are mounted in conductive communication with respective ones of the plurality of signal traces.

In such assembly, the circuit panel may further have a major surface which is oriented in a horizontal direction. Such assembly further includes vertical interconnection elements, each having a ground plane oriented in a vertical direction and one or more signal conductors oriented in the vertical direction and separated from the ground plane by a dielectric. In such assembly, the first transmission line portion and the second transmission line portion are in conductive communication with the signal traces of the circuit panel through the signal conductors of the vertical interconnection elements.

In one assembly in accordance with an aspect of the invention, each vertical interconnection element has top and bottom surfaces and contacts disposed on the top and bottom surfaces. The contacts are conductively connected to the ground plane and to the signal traces.

A cavity resonator in accordance with another aspect of the invention includes a shielded enclosure enclosing a volume. A unitary conductor is disposed within the volume, such conductor having a first inductor portion and a transmission line portion included in a transmission line. The transmission line further includes a reference conductor which is separated from the transmission line portion by a dielectric element. An active semiconductor device is coupled to the unitary conductor and is operable to conduct a current to the unitary conductor at a resonant frequency of the unitary conductor.

A method of making a cavity resonator is provided in accordance with another aspect of the invention. In such method, a first dielectric element is provided which has a first unitary conductor and a first ground conductor disposed on first and second opposite sides of the first dielectric element. The first unitary conductor includes a first transmission line portion disposed on the first side opposite the first ground conductor and a first inductor portion disposed on the first side at locations not opposite the first ground conductor. A second dielectric element is provided in which a second unitary conductor and a second ground conductor are disposed on first and second opposite sides of the second dielectric element. The second unitary conductor includes a second transmission line portion disposed on the first side opposite the second ground conductor and a second inductor portion disposed on the first side at locations not opposite the second ground conductor. The first dielectric element is mounted within a first chamber of a shielded enclosure and the second dielectric element is mounted within a second chamber of a shielded enclosure. The first and second chambers are shielded from each other and have an opening allowing a predetermined proportion of energy to be coupled between the first chamber and the second chamber.

In accordance with one or more further aspects of the invention, each of the first dielectric element and the second dielectric element has sheet-like form and extends in horizontal directions of the cavity resonator. An end of the first inductor portion is vertically displaced a first predetermined height from the first dielectric element and an end of the second inductor portion is vertically displaced a second predetermined height from the second dielectric element.

In a particular aspect of the invention, the first predetermined height is equal to the second predetermined height.

In a method of making a cavity resonator in accordance with one or more further aspects of the invention, the first and second dielectric elements are mounted such that the first transmission line portion and the second transmission line portion extend through the openings in the shielded enclosure to locations outside the shielded enclosure.

In a method of making a cavity resonator in accordance with one or more further aspects of the invention, the first inductor portion is provided by forming a first spiral pattern on the first dielectric element, and the second inductor portion is provided by forming a second spiral pattern on the second dielectric element. A portion of the first dielectric element underlying the first spiral pattern is removed and a portion of the second dielectric element underlying the second spiral pattern is removed prior to vertically displacing ends of the spiral patterns so as to vertically displace the ends of the first inductor portion and the second inductor portion.

In a method of making a cavity resonator in accordance with one or more further aspects of the invention, the first and second dielectric elements are portions of a unitary dielectric element.

In a method of making a cavity resonator in accordance with one or more further aspects of the invention, the first and second dielectric elements are physically separated from each other.

DETAILED DESCRIPTION

As discussed above, good noise rejection and narrow passband operation is important to the operation of radio frequency receiving and transmitting equipment. As the size of such equipment is reduced with each new generation of devices such as cellular phones, two-way radios, wireless personal digital assistant (PDA) devices, and broadcast receivers, it is important that filters used in them meet the demands for both the high noise rejection and the small size.

The most preferred high Q cavity resonators according to the embodiments of the invention described herein satisfy these demands. In addition, cavity resonator structures and methods of fabricating them are provided herein which are less expensive to fabricate than the large, bulky cavity resonators described above as background to the invention.

Figure 1:
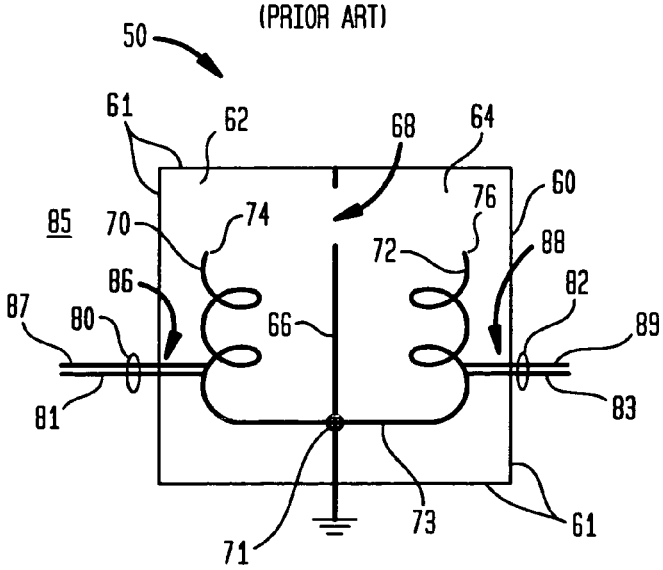
FIG. 1 (PRIOR ART)
FIG. 1 is a side view schematically illustrating a conventional cavity resonator.
Figure 2:
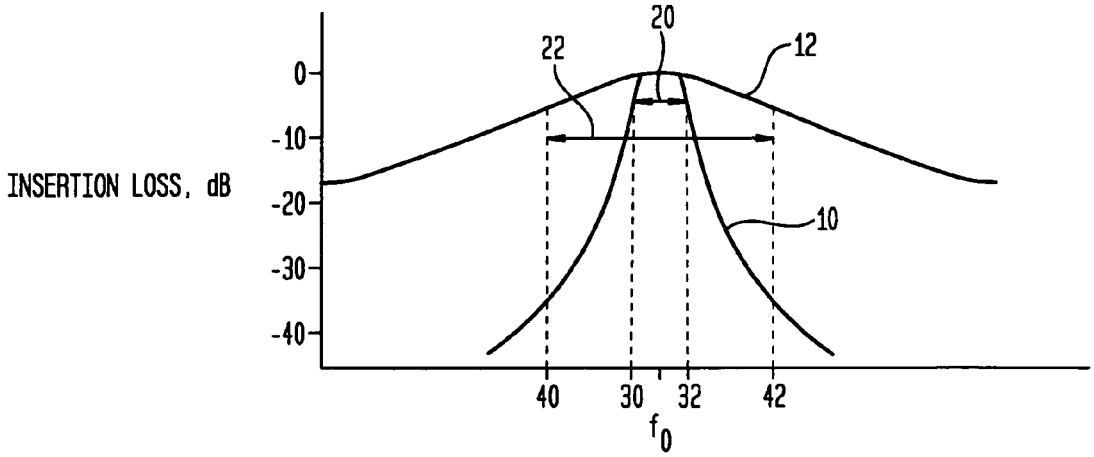
FIG. 2 is a graph illustrating a frequency response of a cavity resonator relative to that of a lumped passive circuit element.
Figure 3:
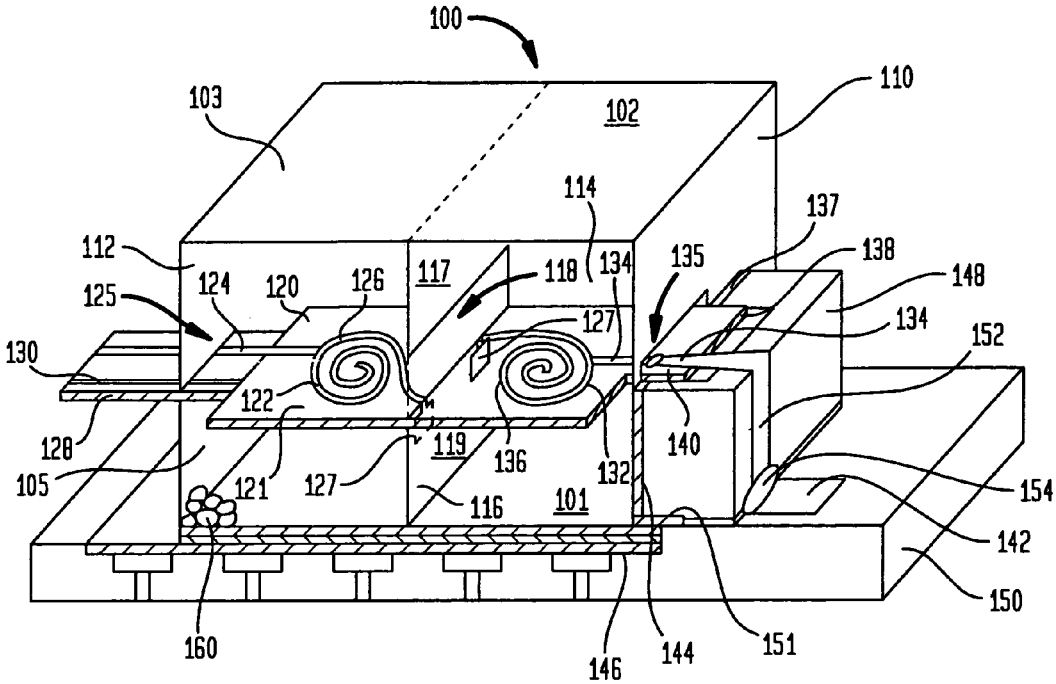
FIG. 3 is a cutaway perspective drawing illustrating a cavity resonator according to one embodiment of the invention.

FIG. 3 illustrates a first embodiment of a two-chamber cavity resonator 100 according to an embodiment of the invention. As shown therein, the cavity resonator 100 includes some of the features of the cavity resonator 50 which are described above as background to the invention. Thus, the cavity resonator 100 includes a shielded enclosure 110 which encloses a first volume 112 and a second volume 114. The shielded enclosure is formed by stamping, folding, shaping, or otherwise forming metallic members, e.g., a metallic sheet, into a generally cubic or cuboid, i.e. "boxlike", shape. Desirably, the shielded enclosure is formed of a metal such as copper or aluminum which is easily worked in such manner, has high conductivity and is readily available at a reasonable cost. In one embodiment, a silver coating is applied at least to the interior surfaces of the shielded enclosure, e.g., by electroplating or other widely used method. Silver is especially advantageous because it has higher conductivity than any other material at operating temperatures and conditions, i.e., between about −54° C. and 150° C. in which all but the most exotic of microelectronic devices are normally operated. In addition, oxides of silver are conductive such that some oxidation of the silver coating is permitted without causing the conductivity of the silver coating to degrade excessively.

The shielded enclosure includes a metallic divider 116 which functions to separate the first volume 112 from the second volume 114 except for an opening 118 through which a predetermined proportion of the electromagnetic wave energy present in the first volume is coupled into the second volume 114.

As in the cavity resonator described in the background, the cavity resonator shown in FIG. 3 has a transmission line which is joined to the inductive element of the resonator at a position which results in a matched impedance. A particular feature of this embodiment is the unitary construction in which the transmission line conductors of the cavity resonator are formed integrally with the inductive elements such that the transmission lines are terminated consistently in matching 50Ω impedances, thus eliminating the need for manual, hand-tuned adjustments to determine the attachment locations for the transmission lines.

The transmission line elements are provided on a sheet-like dielectric element 120 which extends within the first and second volumes 112, 114 of the shielded enclosure. In the embodiment shown in FIG. 3, the dielectric element 120 is disposed at a position at about midway between a bottom side 101 of the shielded enclosure and a top side 102 of the shielded enclosure. In a particular form of such embodiment, the shielded enclosure includes a top enclosure which encloses an upper portion 103 of the space within the shielded enclosure above the dielectric element 120. A bottom enclosure encloses a lower portion 105 of the space within the shielded enclosure below the dielectric element 120. In such embodiment, the metallic divider 116 includes a top divider 117 which divides a top portion of the first volume from a top portion of the second volume. In such embodiment, the metallic divider 116 further includes a bottom divider 119 which divides a bottom portion of the first volume from a bottom portion of the second volume.

The dielectric element 120 includes one or more dielectric layers, on which the below-described metallic traces are formed, such layers being formed of materials, such as polyimide and the like. Alternatively, the dielectric layers are formed, such as by electrophoretic deposition, onto a metallic layer of the dielectric element 120.

A first unitary trace 122 is disposed within the first volume 112, the first unitary trace 122 including a first transmission line trace 124 and a first inductor trace 126. The first transmission line trace 124 includes an active conductor of a first transmission line. A first reference trace 128 also extends along the dielectric element 120 and is separated from the first transmission line trace 124 by a dielectric layer 130 of the dielectric element 120. As coupled for operation in a circuit, the first reference trace 128 is coupled to a fixed potential such as ground, and provides a source of reference potential for the transmission line including itself and the first transmission line trace. The first transmission line trace may even be coupled to one or more walls of the shielded enclosure 110.

Similarly, a second unitary trace 132 is disposed within the second volume 114, the second unitary trace 132 including a second transmission line trace 134 and a second inductor trace 136. A second reference trace 138 also extends along the dielectric element 120 and is separated from the second transmission line trace 134 by a dielectric layer 140 of the dielectric element 120. The second transmission line trace 134 and the second reference trace 138 together form a transmission line, the second reference trace 138 being coupled to a fixed potential such as ground.

Each of the first and the second inductor traces 126, 136 have ground ends 127 which are grounded, such as by mounting them in conductive communication with the shielded enclosure 110. In one embodiment, the ground ends 127 are mounted by adhesive or solder bonding to the metallic divider 116, as shown in FIG. 3, or other interior wall of the shielded enclosure 110. These mountings are provided in a manner with or without the inductor traces being bonded or mounted to one or more intermediate elements.

As shown in FIG. 3, the first and second inductor traces 126, 136 are spiral elements disposed on an upper surface 121 of the dielectric element 120. The spiral arrangement helps maintain the geometry of the metallic inductor traces 126, 136. Methods of providing inductive elements on various types of dielectric elements, including web-like or tape-like elements, are described in commonly assigned U.S. patent application Ser. Nos. 10/210,160 filed Aug. 1, 2002 and 10/452,333 filed Jun. 2, 2003, the entire contents of which are incorporated herein by reference. In one embodiment, the dielectric element 120 presents an upper surface 121 which is at least generally planar, such that the inductor traces are disposed in spiral patterns on the upper surface 121 of the dielectric element 120. However, in some embodiments, as are described more fully below, the dielectric element 120 includes a raised or indented surface underlying the spiral inductive traces, so as to impart a somewhat helical geometry to the inductor traces.

Transmission lines including the transmission line traces 124 and 134 extend through openings 125, 137 from locations inside the shielded enclosure 110 to positions external thereto for the purpose of making external connections. As shown in FIG. 3, a transmission line 135 including the second transmission line trace 134, dielectric layer 140 and reference trace 138 extends to a location external to the shielded enclosure 110. At least the transmission line traces of the first and second transmission lines are insulated at the openings in walls of the shielded enclosure 110. As further shown in FIG. 3, the transmission line 135 is conductively connected to a trace 142 on a circuit panel, which is, illustratively, any of many available types of boards, carriers, substrates having traces patterned thereon for conducting currents and voltages between elements affixed thereto. In this regard, the term "on" and "along" are meant broadly to include patterns either disposed on an exterior surface of such circuit panel or rather, disposed within the interior of the circuit panel. In one embodiment, the transmission line 135 is interconnected to trace 142 through an interconnection element 148 having a structure such as that described in commonly assigned U.S. Provisional Application No. 60/576,170 filed Jun. 2, 2004, the entire contents of which are hereby incorporated herein by reference. In some embodiments described therein, the interconnection element 148 has a structure similar to a sawed portion of a printed circuit board, such as an FR-4 type (e.g., epoxy resin) board, which has been up-turned onto one end and mounted to the circuit panel 150. With such interconnection element 148, the reference trace 138 of the transmission line is conductively connected to a vertically disposed ground plane 144 of the interconnection element 148 which in turn, is connected to a ground plane 146 of the circuit panel 150. The ground plane 144 of the interconnection element is itself bonded to the ground plane 146 of the circuit panel, as by solder bond or conductive adhesive bond 151. In the embodiment shown, the ground plane 146 of the circuit panel 150 extends under and is conductively bonded to the entire bottom side 101, of the shielded enclosure 110, e.g., by solder, so as to provide a stable and effective ground for the cavity resonator. Further, the transmission line trace 134, which extends through the opening 137 in the wall of the shielded enclosure 110, is conductively connected to a trace 152 of the interconnection element 148, the trace 152, in turn, being conductively connected to the trace 142 on the circuit panel, such as through a solder bond 154.

As discussed above, one objective of cavity resonators according to some embodiments of the invention is to provide small-size resonators suitable for use in microelectronic assemblies. Another consideration, which can sometimes be at odds with reducing the size, is the need to manufacture a cavity resonator having a resonant frequency which is usable at frequencies used in microelectronic circuits today. Generally speaking, the smaller size that the cavity resonator has, the higher the resonant frequency will be. However, this relationship can be altered by loading the chamber that houses the inductive element with a dielectric material. In order to achieve the greatest reduction in the resonant frequency, high-K dielectric materials can be used, such as perovskite materials, ferroelectric dielectric materials, e.g., barium strontium titanate (BSTO), zeolites, and the like. Otherwise, medium-K materials such as various glasses and oxides can be used. In one embodiment, the dielectric loading material is formed into nodules, which may be ball-shaped or otherwise. At a near completion stage of manufacture, after the inductive elements have been formed and positioned within the chambers of the cavity resonator, the ball-shaped nodules 160 (FIG. 3) are poured in a fluid manner into the chambers of the cavity resonator to fill the space between the inductive elements and the walls of the chamber. In another embodiment, the dielectric material is suspended in an extrudable material such as a self-curing polymer, thermoset polymer or other organic material. That material is extruded into the chambers of the cavity resonator, e.g., chambers 112, 114 of resonator 110, or chambers 204 of resonator 200, after the inductive elements are placed in their final positions, to fill the spaces between the inductive elements and the walls of the chambers.

Figure 4:
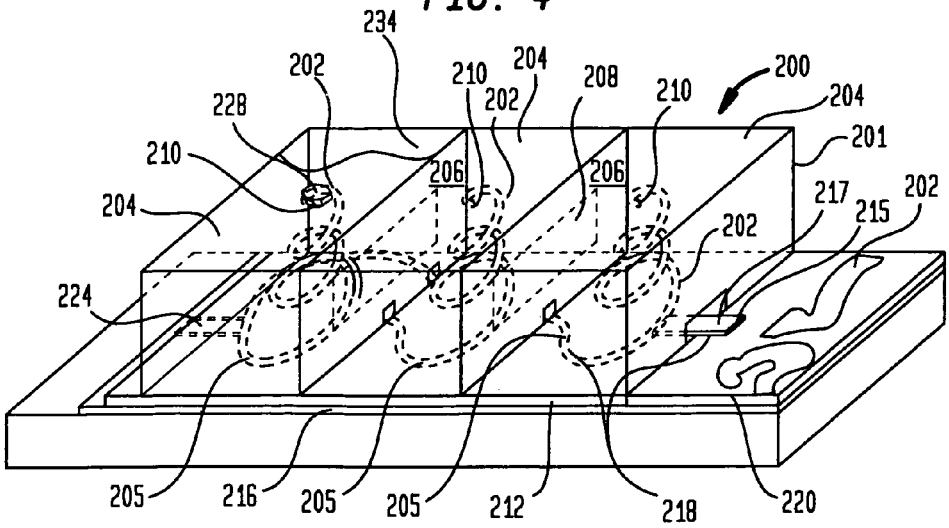
FIG. 4 is a cutaway perspective drawing illustrating a cavity resonator according to another embodiment of the invention.

FIG. 4 illustrates another embodiment of a cavity resonator 200 according to the invention. The cavity resonator according to this embodiment is similar to that shown and described above relative to FIG. 3, except for the number of inductive elements, the particular geometry of the inductive elements and of the shielded enclosure. In this embodiment, a shielded enclosure 201 houses three spiral helical inductive elements 202, each of which is generally in the shape of a helix which is tapered from a larger coil 205 of the inductive element towards a smaller open end 210 of the coil. While three inductive elements 202 are shown in FIG. 3, fewer inductive elements may be provided, as described above relative to FIG. 3. Alternatively, more than three inductive elements may be provided in a manner similar to that described here. Each of the inductive elements 202 is disposed in a substantially separate chamber 204 of the shielded enclosure 201, the chamber being cubic or cuboid in shape. Similar to the embodiment described above relative to FIG. 3, each chamber 204 is substantially separated by one or more metallic dividers 206 from the other two chambers 204 of the enclosure 201, except for openings 208 provided in the metallic dividers 206.

In a particular embodiment, the inductive elements 202 are disposed at least partially as inductive traces (e.g. at larger coils 205) on a sheet-like dielectric element 212 having portions which are bonded to a metallic sheet 216. The open end 210 of each inductive trace is vertically displaced from the metallic sheet 216. For example, the open end 210 may be mounted through a dielectric block 228 that is also mounted to the interior surface of a top side 234 of the shielded enclosure 201. A ground end 214 of each inductive trace is conductively bonded to the shielded enclosure 201 or other available source of a fixed potential such as ground. The inductive element 202 is one part of a unitary trace 218 in each chamber 204 which includes the inductive trace, e.g. trace 205, and a transmission line trace 215 that is disposed at an essentially fixed spacing in relation to the metallic sheet 216, the metallic sheet 216 functioning as a reference trace or reference conductor for a transmission line including the transmission line trace 215, the dielectric element 212 and the metallic sheet 216.

The metallic sheet 216 forms a ground plane of a circuit panel, and also functions as a bottom side of the shielded enclosure 201. Circuit traces 222 are also disposed on the dielectric element 212 in portions 220 thereof which extend externally to the shielded enclosure 201.

The three-chambered cavity resonator 200 has an input end at a first transmission line 224 feeding into a first chamber of the shielded enclosure 201, and an output end from a second transmission line 217 emerging from another chamber of the shielded enclosure 201. As in the embodiment described above relative to FIG. 3, the three-chambered resonator 200 is mounted to the circuit panel 230 and conductively connected to traces on the circuit panel 230, as through solder or adhesive bonding.

Figure 5:
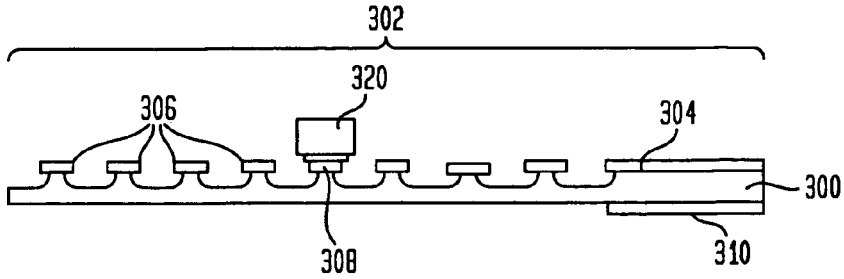
FIG. 5 is a sectional diagram illustrating a stage of fabrication of a cavity resonator according to one embodiment of the invention.

FIG. 5 is a sectional view illustrating a stage in the fabrication of a cavity resonator such as that shown in FIG. 4, according to an embodiment of the invention. In a particular embodiment, each inductive element 202 is formed as a spiral element disposed on the surface of a planar dielectric layer 300 of a dielectric element. Thereafter, the inductive trace is separated from the dielectric layer to form the inductive element having the desired spiral helical shape. As shown in FIG. 5, a dielectric sheet 300 is provided having a first patterned metal layer 302 thereon, the layer 302 including a unitary trace having a transmission line trace 304 and an inductive trace 306. The inductive trace 306 is formed in a spiral pattern, such as that shown and described above as elements 126, 136 shown in FIG. 3. The inductive trace 306 is formed, e.g., in a subtractive process, from a layer of metal disposed on the dielectric sheet 300, which is patterned, as by a masked etch. Thereafter, with the inductive trace 302 remaining in place over the dielectric sheet 300, further etching is performed of the dielectric sheet 300 underlying the inductive trace 306, using an etchant which does not etch or only slightly etches the metal of the inductive trace 302. As a result of such etching, the metallic pattern of the inductive trace is undercut to reduce the area of the dielectric layer 300 in contact with the inductive trace, resulting in the structure as shown. In one embodiment, a reference trace 310 is formed on a bottom side of the dielectric element, such reference trace serving as a reference conductor of a transmission line including transmission line trace 304, dielectric layer 300 and reference trace 310. In another embodiment, such as described above with reference to FIG. 4, a portion of the dielectric layer of the dielectric element is bonded to a metallic bottom side of the shielded enclosure, allowing the metallic bottom side to function as the reference conductor for the transmission line.

As further shown in FIG. 5, a dielectric mounting block 320 is bonded, e.g., via an adhesive, to the open end 308 of the inductive trace, such mounting block 320 being used to mount the open end 308 to the interior wall of the shielded enclosure, such as shown and described above with respect to FIG. 4. Once the open end 308 is mounted to the mounting block 320 in this way, the inductive trace is gradually peeled from the surface of the dielectric layer 300, such that the open end of the inductive trace becomes vertically displaced from the dielectric layer in the center of the inductive trace. In such manner, the inductive trace gradually acquires the desired spiral and helical shape and vertical displacement for installation within the shielded enclosure. Thereafter, the top surface of the dielectric mounting block is bonded, e.g., via an adhesive to the interior surface of the shielded enclosure.

Figure 6:
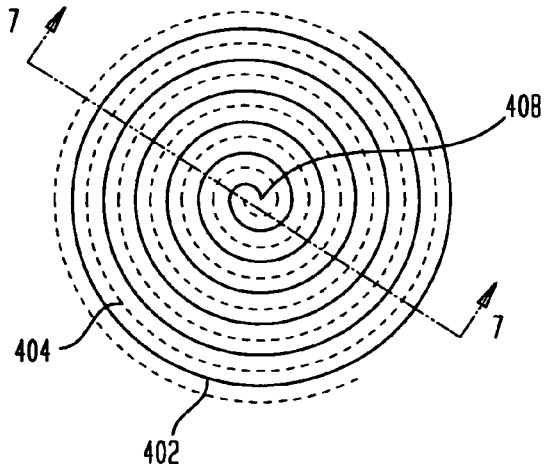
FIGS. 6 and 7 are a top-down view of a portion of a unitary conductor and a corresponding sectional diagram thereof, respectively, illustrating a stage of fabrication of a cavity resonator according to another embodiment of the invention.
Figure 7:
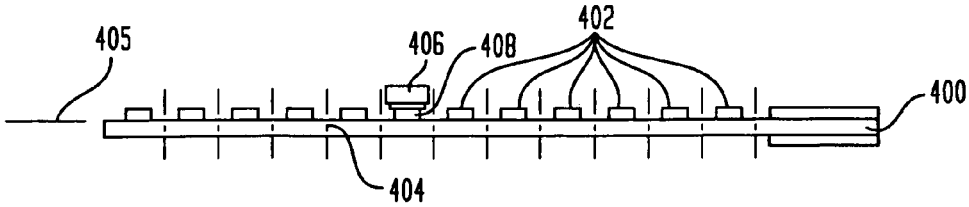

FIG. 6 is a top view illustrating a stage of fabrication of a spiral helical cavity resonator according to another embodiment of the invention in which the inductive trace is formed from a spiral pattern disposed as traces 402 on a dielectric layer 400. FIG. 7 is a corresponding sectional view, through line 7-7 of FIG. 6. In this embodiment, the dielectric layer 400 is scored or severed along the dotted lines 404 between each of a plurality of adjacent traces 402 of the spiral pattern. A dielectric mounting block 406 is bonded to an open end 408 of the pattern in a manner as shown and described above relative to FIG. 5. In this arrangement, the traces 402 of the spiral pattern can be vertically displaced from a reference plane 405 of the dielectric element by moving the dielectric mounting block 406 away from the reference plane 405. Once the mounting block 406, with the open end 408 attached, has been vertically displaced, the mounting block 406 is bonded to an interior surface of the shielded enclosure in the manner set forth above relative to FIG. 4.

Figure 8:
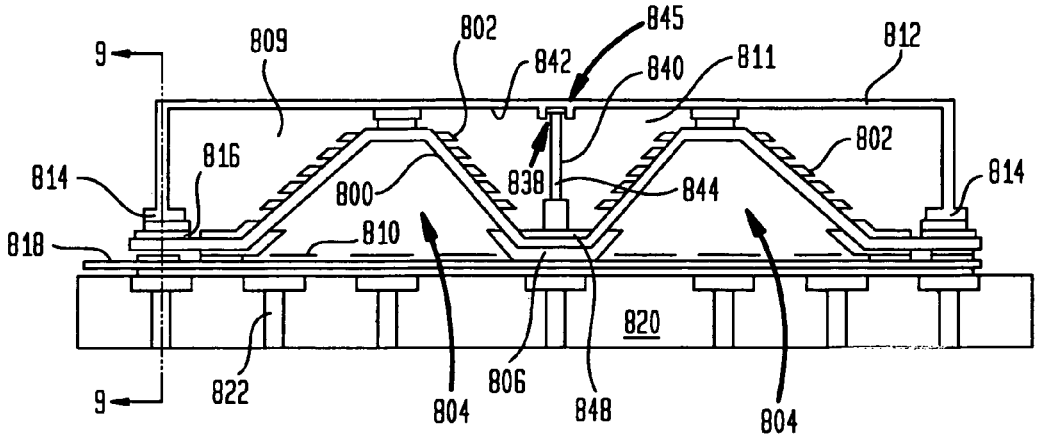
FIG. 8 is a sectional view of a cavity resonator according to another embodiment of the invention.
Figure 9:
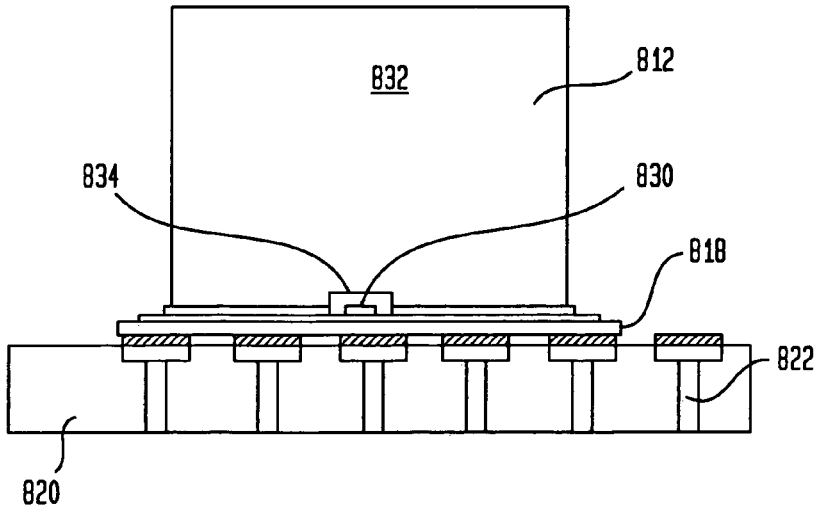
FIG. 9 is an exterior view, through lines 9-9, of a cavity resonator according to the embodiment of the invention illustrated in FIG. 8.

FIG. 8 is a sectional view illustrating a spiral helical cavity resonator according to still another embodiment of the invention. FIG. 9 is a corresponding side view of the resonator, through line 9-9 of FIG. 8. In this embodiment, spiral helical inductive traces 802 is disposed on a surface of a dielectric layer 800 which includes portions 804 which are vertically displaced, as by indenting, from a reference plane 810 thereof on which a reference conductor 806 is disposed. As shown in FIG. 8, the inductive traces 802 are disposed within a first chamber 809 and a second chamber 811 of a shielded enclosure 812. The shielded enclosure is similar to the shielded enclosure described above with respect to FIG. 4. However, flanges 814 are provided for mounting outer walls of the shielded enclosure 812, as by solder or conductive adhesive, to a conductive member 816 disposed on a surface of the dielectric layer 800. Through conductive member 816, a conductive interconnection is provided to a ground plane 818 and to a circuit panel 820, in turn, to which it is conductively bonded. The circuit panel 820 further includes metallic members 822, e.g., posts and/or plated through holes, extending from a top side to a bottom side of the circuit panel, for the purpose of further extending the ground path in a series of low-resistance interconnects.

As shown in FIG. 9, a transmission line trace 830 emerges outside the shielded enclosure from a position inside a first chamber thereof. The transmission line trace 830 is electrically insulated from the metallic wall 832 of the shielded enclosure 812, as by a dielectric encapsulating material 834 which is disposed between the transmission line trace 830 and the edge of an opening in the metallic wall from which the transmission line trace 830 emerges from the shielded enclosure.

Referring again to FIG. 8, a metallic divider 840 is disposed with a top end soldered or otherwise bonded to an interior surface 842 of the shielded enclosure. Desirably, the metallic divider 840 is mounted at a top end 838 to the shielded enclosure at a position disposed within a slot 845 formed in the wall of the shielded enclosure. At a lower end 844, the metallic divider 840 is bonded, e.g., through solder or conductive adhesive bond, to the ground ends of conductive traces disposed on the dielectric sheet 800.

Figure 10:
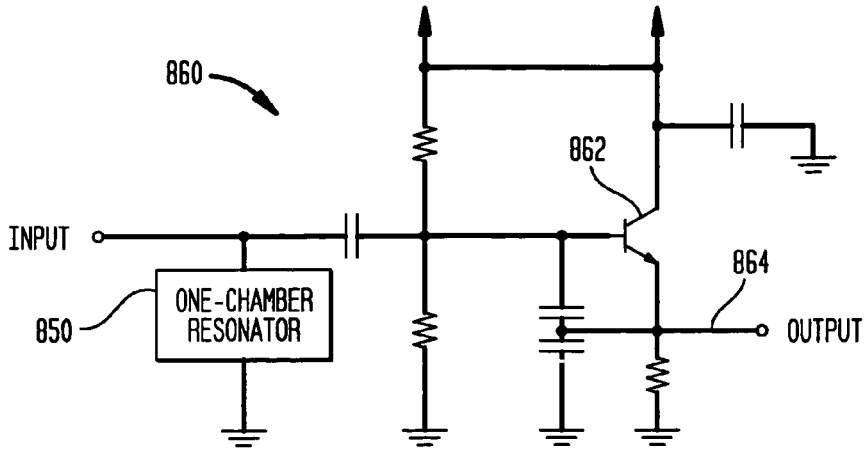
FIG. 10 is a schematic circuit diagram illustrating an application of a one chamber cavity resonator according to an embodiment of the invention.

FIG. 10 illustrates a further embodiment of the invention in which a filter 860 is constructed using a resonator 850 similar to the resonators provided according to one of the other embodiments described above with respect to FIG. 3, FIGS. 4-7 or FIGS. 8-9, except that the resonator includes a single chamber having a single inductive element disposed therein. In this embodiment, the values of the various resistors and capacitors of the circuit are selected to bias the transistor 862 in a manner which amplifies the frequency selected by the one chamber resonator 850, as appears at the output 864 of the circuit.

Figure 11:
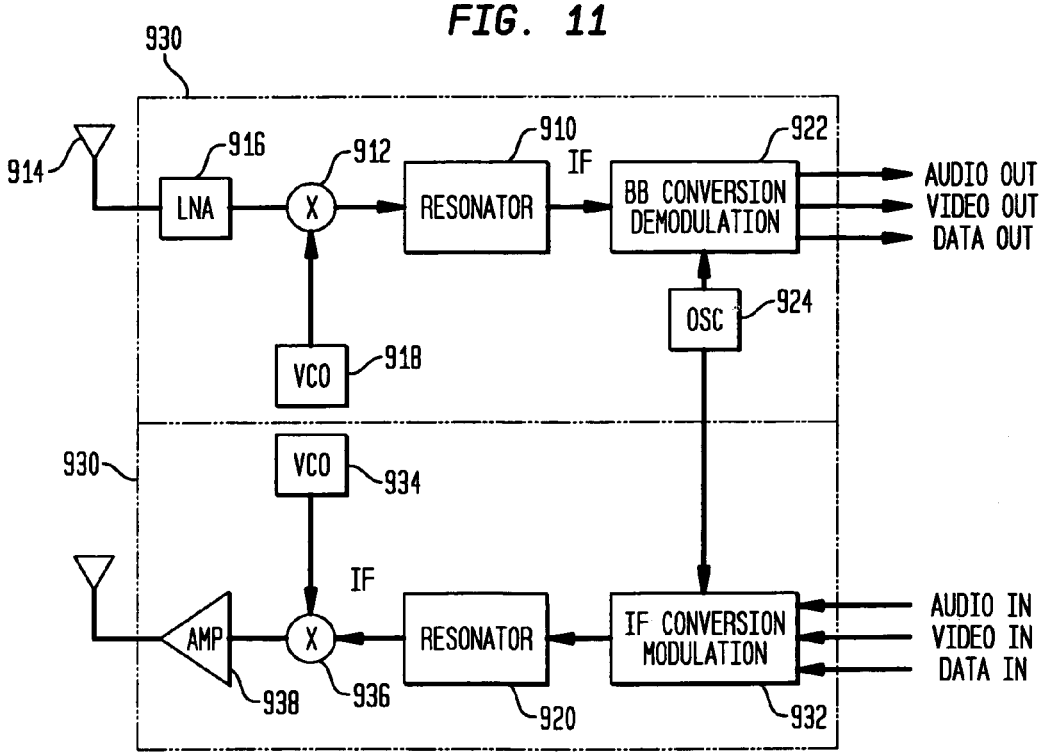
FIG. 11 is a functional block diagram illustrating an application of a cavity resonator in a transceiver according to an embodiment of the invention.

FIG. 11 illustrates a transceiver 900 according to another embodiment of the invention, such transceiver 900 being as provided in a cellular telephone or other wireless telephone, or in a portable or non-portable computing device having a wireless interface, e.g., desktop or notebook computer, or as provided in a personal digital assistant, or other wireless communication device. As shown therein, transceiver 900 includes two helical cavity resonators 910, 920. In such transceiver, a receiver portion 930 includes a resonator 910 such as that described above with respect to FIG. 3, 4, or 10 above, which is used to select the passband of the output of a mixer 912 used to downconvert a signal received over an antenna 914 through low noise amplifier 916, as multiplied by the output of a variable frequency oscillator, e.g., VCO 918. The output of resonator 910 is a bandlimited intermediate frequency (IF) signal having a narrow passband as determined by the characteristics of resonator 910. The IF signal from resonator 910 is then input to baseband conversion and demodulation circuitry, shown collectively at 922. Such circuitry 922 may, in one embodiment, utilize output of a local oscillator 924. The output of that circuitry 922 is shown illustratively in FIG. 11 as audio, video and data output, although other types of output, e.g., still-frame image can also be provided.

In a transmitter portion 940 of the transceiver, a resonator 920 is provided such as that described above with respect to FIG. 3, 4, or 10 above, the resonator 920 being used to select a narrow passband including the IF signal output of intermediate frequency conversion and modulation circuitry 932. Illustratively, that IF signal is then converted to a transmission frequency by multiplication with the output of a VCO 934 through a mixer 936, and then further amplified for transmission over an antenna 940 by amplifier 938. Alternatively, the IF output signal of resonator 920 is provided to alternative modulation and transmission means including but not limited to any of the transmission means such as: amplitude modulation, frequency modulation, frequency hopping including that which satisfies one or more standards from the organization "GSM", or is modulated according to spread spectrum techniques, e.g., code data multiple access (CDMA), and one or more data transmission standards such as General Packet Radio Service ("GPRS") or cellular digital packet data "CDPD").

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A cavity resonator, comprising:

a dielectric element having one or more dielectric layers;

a shielded enclosure overlying at least a portion of said dielectric element, said shielded enclosure enclosing a first volume and a second volume and having a metallic divider separating the first volume from the second volume;

a first unitary trace disposed within the first volume, said first unitary trace including a first transmission line trace having a major surface extending along a surface of said dielectric element and a first inductor trace having a major surface extending along a surface of said dielectric element; and a first reference trace extending along said dielectric element and separated from said first transmission line trace of said first unitary trace by at least one dielectric layer of said dielectric element;

a second unitary trace disposed within the second volume, said second unitary trace including a second transmission line trace having a major surface extending along a surface of said dielectric element and a second inductor trace having a major surface extending along said surface of said dielectric element; and a second reference trace extending along said dielectric element and separated from said second transmission line trace of said second unitary trace by at least one dielectric layer of said dielectric element;

wherein said metallic divider has an opening adapted to permit a predetermined proportion of energy of an electromagnetic field excited by the first inductor trace to be coupled onto the second inductor trace.

2. The cavity resonator as claimed in claim 1, wherein the shielded enclosure includes a top enclosure enclosing portions of the first volume and the second volume above the dielectric element, a bottom enclosure enclosing portions of the first volume and the second volume below the dielectric element, and the metallic divider includes a top divider separating the first volume from the second volume within the top enclosure and a bottom divider separating the first volume from the second volume within the bottom enclosure.

3. A cavity resonator as claimed in claim 1, wherein each of the first inductor trace and the second inductor trace has spiral form.

4. The cavity resonator as claimed in claim 1, wherein the dielectric element includes a plurality of third traces disposed outside said shielded enclosure, at least some of said third traces not being connected to either said first unitary trace or said second unitary trace.

5. The cavity resonator as claimed in claim 4, wherein the dielectric element includes a ground plane separated from said third traces by at least one dielectric layer of said dielectric element, said ground plane being connected to said first and second reference conductors.

6. A cavity resonator as claimed in claim 1, wherein each of the first inductor trace and the second inductor trace has helical form.

7. A cavity resonator as claimed in claim 6, wherein each of the first inductor trace and the second inductor trace has tapered helical form.

8. The cavity resonator as claimed in claim 1, wherein the dielectric element includes a substantially planar surface disposed outside the shielded enclosure and first and second frusto-conical inductor surfaces disposed inside the shielded enclosure, the first and second inductor surfaces having tops displaced vertically from said planar surface, said first and second inductor traces each being disposed in a spiral pattern along said first and second inductor surfaces, respectively.

9. The cavity resonator as claimed in claim 8, wherein said, first and second transmission line traces and said first and second reference traces are disposed on opposite sides of said planar surface.

10. The cavity resonator as claimed in claim 9 further comprising a ground plane, wherein said first and second reference traces are portions of said ground plane.

11. A cavity resonator, comprising:

a shielded enclosure enclosing a first volume and a second volume, having a shield separating the first volume from the second volume;

a first unitary conductor extending within the first volume and a first reference conductor extending within the first volume, the first unitary conductor having a first inductor portion disposed within the first volume and a first transmission line portion, a first dielectric element extending between the first transmission line portion and the first reference conductor so that the first transmission line portion of the first unitary conductor, the first dielectric element and the first reference conductor define a first transmission line and wherein the first inductor portion and the first transmission line portion have a major surface extending along a surface of said first dielectric element; and a second unitary conductor extending within the second volume and a second reference conductor extending within the second volume, the second unitary conductor having a second inductor portion disposed within the second volume and a second transmission line portion, a second dielectric element extending between the second transmission line portion and the second reference conductor so that the second transmission line portion of the second unitary conductor, the second dielectric element and the second reference conductor define a second transmission line and wherein the second inductor portion and the second transmission line portion have a major surface extending along a surface of said second dielectric element, wherein the shield has an opening allowing a predetermined proportion of energy radiated by the first inductor portion to be radiatively coupled to the second inductor portion.

12. A cavity resonator as claimed in claim 11, wherein each of the first enclosed volume and the second enclosed volume has substantially cuboid shape.

13. A cavity resonator as claimed in claim 11, wherein each of the first inductor portion and the second inductor portion has spiral form.

14. A cavity resonator as claimed in claim 11, wherein the first transmission line and the second transmission line extend through one or more openings in the shielded enclosure to locations outside the shielded enclosure.

15. A cavity resonator as claimed in claim 14, further comprising one or more encapsulating members insulating the first transmission line and the second transmission line at the one or more openings.

16. An assembly including a cavity resonator as claimed in claim 11, further comprising a circuit panel having a plurality of signal traces, wherein the first transmission line portion and the second transmission line portion are mounted in conductive communication with respective ones of the plurality of signal traces.

17. An assembly as claimed in claim 16, wherein the circuit panel has a major surface oriented in a horizontal direction, the assembly further comprising vertical interconnection elements each having a ground plane oriented in a vertical direction and one or more signal conductors oriented in the vertical direction and separated from the ground plane by a dielectric, the first transmission line portion and the second transmission line portion being in conductive communication with the signal traces of the circuit panel through the signal conductors of the vertical interconnection elements.

18. An assembly as claimed in claim 17, wherein each vertical interconnection element has top and bottom surfaces and contacts disposed on the top and bottom surfaces, the contacts conductively connected to the ground plane and to the signal traces.

19. A cavity resonator as claimed in claim 11, wherein the first dielectric element and the second dielectric element are portions of a unitary dielectric element.

20. The cavity resonator as claimed in claim 19, wherein the first reference conductor and the second reference conductor are adapted to be connected to the same reference potential.

21. A cavity resonator as claimed in claim 19, wherein the first inductor portion and the second inductor portion include ground ends conductively bonded to the shielded enclosure.

22. A cavity resonator as claimed in claim 21, wherein the first reference conductor and the second reference conductor are portions of a unitary ground conductor including a ground plane portion disposed at an interior surface of the shielded enclosure.

23. A cavity resonator as claimed in claim 21, wherein the shielded enclosure includes an inner surface having a silver coating disposed thereon.

24. A cavity resonator as claimed in claim 23, wherein at least the first inductor portion and the second inductor portion include silver coatings.

25. A cavity resonator as claimed in claim 11, wherein each of the first inductor portion and the second inductor portion has helical form.

26. A cavity resonator as claimed in claim 25, wherein each of the first inductor portion and the second inductor portion has tapered helical form.

27. The cavity resonator as claimed in claim 25, further comprising a first dielectric mounting element and a second dielectric mounting element, wherein the first inductor portion has a first open end and a first ground end opposite the first open end and the second inductor portion has a second open end and a second ground end opposite the second open end, the first open end mounted to the first dielectric mounting element and insulated from the shielded enclosure thereby and the second open end mounted to the second dielectric mounting element and insulated from the shielded enclosure thereby.

28. The cavity resonator as claimed in claim 27, wherein the first dielectric mounting element and the second dielectric mounting element are mounted to the shielded enclosure.

29. A cavity resonator as claimed in claim 25, further comprising a dielectric loading material occupying at least a substantial portion of the first volume and the second volume.

30. A cavity resonator as claimed in claim 29, wherein the dielectric loading material includes a multiplicity of solid dielectric nodules.

* * * * *

UNITED STATES PATENT AND TRADEMARK OFFICE

CERTIFICATE OF CORRECTION

PATENT NO. : 7,583,165 B2
APPLICATION NO. : 11/319849
DATED : September 1, 2009
INVENTOR(S) : Ronald Green It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 612 days.

Signed and Sealed this

Fourteenth Day of September, 2010

David J. Kappos

David J. Kappos
*Director of the United States Patent and Trademark Office*